United States Patent [19]

Haraga et al.

[11] Patent Number: 4,460,629

[45] Date of Patent: Jul. 17, 1984

[54] PROCESS FOR PREPARATION OF RESIN-COATED MOLDING SAND

[75] Inventors: Tetsuo Haraga, Toyota; Ryuji Nomura, Anjo; Isao Kai; Motoyoshi Yamasaki, both of Aichi, all of Japan

[73] Assignees: Toyota Jidosha Kogyo Kabushiki Kaisha, Aichi; Asahi Yukizai Kogyo Kabushiki Kaisha, Miyazaki, both of Japan

[21] Appl. No.: 338,038

[22] Filed: Jan. 8, 1982

Related U.S. Application Data

[63] Continuation-in-part of Ser. No. 324,681, Nov. 25, 1981, abandoned.

[30] Foreign Application Priority Data

May 21, 1981 [JP] Japan ..... 56-77056

[51] Int. Cl.[3] ..... B05D 7/00

[52] U.S. Cl. ..... 427/221; 427/134; 427/407.1; 523/143; 164/526

[58] Field of Search ..... 427/134, 221, 299, 407.1; 523/143, 142; 164/526

[56] References Cited

U.S. PATENT DOCUMENTS

| | | | |
|---|---|---|---|
| 3,590,902 | 7/1971 | Walker et al. | 164/43 |
| 3,745,139 | 7/1973 | Kachur et al. | 523/143 X |
| 4,333,513 | 6/1982 | Craig | 164/526 |

FOREIGN PATENT DOCUMENTS

| | | | |
|---|---|---|---|
| 530256 | 9/1956 | Canada | 427/221 |

*Primary Examiner*—John D. Smith
*Assistant Examiner*—Bernard F. Plantz
*Attorney, Agent, or Firm*—Parkhurst & Oliff

[57] ABSTRACT

The process for preparing a resin-coated casting sand by coating sand grains with a binder comprising a liquid phenolic resin component and a polyisocyanate component, the improvement of which comprises coating sand grains with an organic solvent prior to coating of the sand grains with the binder, thereby prolonging the bench life of the resulting resin-coated casting sand and enhancing the strength of a casting mold prepared from this resin-coated casting sand. Furthermore, this process enables the utilization of sand of a low grade or reclaimed sand having a high alkaline component content, that has not been used in the conventional process, and the supply of an excellent resin-coated casting sand which is capable of providing a casting mold having a high strength and has a long bench life.

8 Claims, No Drawings

PROCESS FOR PREPARATION OF RESIN-COATED MOLDING SAND

This is a continuation in part of U.S. patent application No. 324,681, filed Nov. 25, 1981, now abandoned.

BACKGROUND OF THE INVENTION (1) Field of the Invention

The present invention relates to a process for the preparation of a resin-coated molding sand which is capable of providing a casting mold having a high strength and has a long bench life, and also to a resin-coated molding sand prepared according to this process.

(2) Description of the Prior Art

The so-called Ashland method (Ashland cold box method and Ashland no-bake method) for preparing a casting mold, in which sand grains are coated with a binder comprising a phenolic resin component and a polyisocyanate component and curing is effected by using a base, an amine or a metal ion as a catalyst, is publicly known. In this Ashland method, resin-coated sand grains need not be heated for curing and therefore, this method is very advantageous over the shell molding method or hot box method in which a large quantity of energy is consumed. This Ashland method, however, still involves the following defects.

(1) When the grade of molding sand is low, a large quantity of the resin must be used. More specifically, when molding sand having a low grade, for example, sand containing large quantities of fine particles, sand having a high clay content or sand having bad particle configurations, is used, if the resin is not added in an amount much larger than the ordinary amount, a casting mold having sufficient strength cannot be obtained. However, the increase in the amount of the resin may raise the manufacturing cost and reduce the flowability of the resin-coated sand, thereby causing such troubles as insufficient filling of the casting mold and gas defects.

The reason why sand containing large quantities of fine particles, requires the larger amount of the resin is that the total surface area of the sand grains is larger, so that, in order to obtain a casting mold having a predetermined strength by coating the surfaces of the sand grains with the resin, it is necessary to use a larger amount of the resin. In the case of sand having a high clay content, the binder is absorbed in clay and the resin must inevitably be used in an increased amount.

(2) When sand having a high basicity is used, the bench life of the resin-coated sand is very short. The term "bench life" used herein means a period of time from the coating of the sand with the resin to the time when the resin-coated sand being subjected to the chemical reaction can be used for formation of a coating mold without losing binding force. The Ashland method, especially the Ashland cold box method, is used for forming a core mold which is conducted synchronously with the high-speed molding green mold method mainly adopted for formation of a main mold because the curing rapidly proceeds. However, if reclaimed sand containing residual bentonite, which is used for the green mold method, is employed for the Ashland method, curing proceeds in the resin-coated sand grains even in the absence of a catalyst because of an alkaline component of the bentonite and therefore, a sufficient bench life cannot be ensured. Therefore, such reclaimed sand cannot be used with the Ashland method.

The present invention is to eliminate the abovementioned various defects involved in the conventional methods.

SUMMARY OF THE INVENTION

The primary object of the present invention is to provide a process for the preparation of a resin-coated molding sand which is capable of providing a casting mold having a high strength, and a resin-coated molding sand prepared according to this method.

Another object of the present invention is to provide a process for the preparation of a resin-coated molding sand which has a long bench life and a resin-coated molding sand prepared according to this process.

Still another object of the present invention is to provide a process for the preparation of a resin-coated molding sand whereby effective resin-coated molding sand can be prepared even from a molding of a low grade.

The present invention is based on the finding that if sand grains are coated with an organic solvent prior to the coating of sand grains with a binder, there can be obtained a resin-coated molding sand which is capable of providing a casting mold having improved strength and which has a much prolonged bench life.

More specifically, the present invention is characterized in that the sand grains are coated with an organic solvent prior to the coating of the sand grains with the binder comprising a phenolic resin component and a polyisocyanate component.

Other features and objects of the present invention will be apparent from the following description of the invention.

DETAILED DESCRIPTION OF THE PREFERRED EMBODIMENTS

The present invention relates to a process for the preparation of a resin-coated molding sand, which comprises coating sand grains with a binder comprising a phenolic resin component and a polyisocyanate component, and the process of the present invention is characterized in that the sand grains are coated with an organic solvent prior to the coating of the sand grains with the binder. A resin-coated molding sand which is capable of providing a casting mold having a high strength and which has a long bench life can be obtained according to this process of the present invention.

In the preparation of a resin-coated molding sand to be used for the so-called Ashland method for a casting mold by coating and grains with a binder comprising a benzilic ether type phenolic component and a polyisocyanate component in the presence of a base, an amine or a metal ion as a catalyst, the present invention enables the preparation of a resin-coated molding sand having very long bench life, and capable of a providing a casting mold having an enhanced strength, even if sand grains of a low grade are employed.

As organic solvents to be used in the present invention, there can be employed non-polar solvents such as aliphatic hydrocarbons, aromatic hydrocarbons and halogenated hydrocarbons singly or in combination thereof. As polar solvents, there can be employed ketones, esters, ethers, alcohols and fatty acids singly or in combination thereof. Furthermore, a mixture of the above non-polar solvent and polar solvent may be used.

More specifically, the aliphatic hydrocarbons may include, for example, n-hexane, n-heptane and iso-octane; the aromatic hydrocarbons may include, for example, benzene, toluene, xylene and ethylbenzene; and the halogenated hydrocarbons may include, for example, carbon tetrachloride and chlorobenzene.

The ketones may include, for example, acetone, methylisobutyl ketone, isophorone and cyclohexanone; the esters may include, for example, ethyl acetate, diethyl oxalate and diethyl phthalate; the ether may include, for example, isopropyl ether and 1,4-dioxane; the alcohols may include, for example, methanol, ethanol, ethylene glycol, isopropanol and furfuryl alcohol; and the fatty acids may include, for example, acetic acid and propionic acid.

Moreover, there can be used mixed solvents, for example, petroleum solvents such as kerosene, light oil and fuel oil, and commercially available naphtha fractions such as "Hisol 100" supplied by Nippon Oil Co., "Hisol" supplied by Showa Oil Co. and petroleum spirit. These mixed solvents may be used singly or in the form of a mixture with other solvents.

In the present invention, aliphatic hydrocarbons, aromatic hydrocarbons, halogenated hydrocarbons, ketones, esters and mixed solvents are preferably used as the organic solvent.

The non-polar solvent exerts mainly an effect of improving the strength of a casting mold and the polar solvent exerts mainly an effect of prolonging the bench life. Accordingly, if an appropriate mixture of a non-polar solvent and a polar solvent is used, a good balance is advantageously maintained between the strength of a casting mold and the bench life of the resin-coated sand grains.

The organic solvent is used in an amount of 0.01 to 10% by weight, preferably 0.1 to 5% by weight, based on the sand grains. If the added amount of the organic solvent is smaller than 0.01% by weight based on the sand grains, insufficient precoating effect can be attained on the sand grains by the organic solvent. If the added amount of the organic solvent is larger than 10% by weight based on the sand grains, the strength of a casting mold is rather reduced and no good results are obtained.

Ordinarily, the mixing ratio of the organic solvent to sand may be low in the case of sand having a good configuration and low contents of fine particles and clay, while this mixing ratio is required to be relatively increased in the case of sand of a low grade.

The type of a mixer for use in coating sand with the organic solvent is not particularly limited, but a mixer capable of kneading the sand with the organic solvent without generation of heat is preferably used. It is preferred that kneading be carried out at a sand temperature of from —10° to 50° C. Incidentally, an organic solvent containing impurities to such an extent as not degrading the properties of the formed casting mold may be used in the present invention.

In the process of the present invention, since the sand grains are coated with the organic solvent in advance, the wetting property of the binder on the surfaces of sand grains is improved. Furthermore, since the organic solvent acts as a good solvent for the urethanation reaction, effects of improving the strength of the casting mold and prolonging the bench life can advantageously be attained.

In the present invention, not only ordinary molding sand but also low-grade sand having high contents of fine particles and clay and reclaimed sand having a high alkaline component content can be used as the starting sand. The particle size of the starting sand is not particularly critical, but a sand having a particle size of, for example, about 50 to about 600μ, is ordinarily used.

The phenolic resin component to be used as the binder areare resol-type, novolak-type and benzylether-type liquid resins.

As the polyisocyanate component, there can be used, for example, diphenyl-methane diisocyanate, hexamethylene diisocyanate and 4,4'-dicyclogexylmethane diisocyanate.

Each of the above components is added in an amount of 0.01 to 10% by weight based on the sand grains precoated with the organic solvent. The two components of the binder may be added either simultaneously or separately. However, it is not preferred to add the components of the binder simultaneously with the addition of the organic solvent.

Kneading is usually carried out for about 15 to about 60 seconds by using, for example, a high-speed mixer.

Curing of the binder-coated sand grains is accomplished according to the customary method, for example, by blow-packing the above-mentioned mixture into a core box and passing a catalyst gas such as triethylamine through the packed sand grains.

The present invention will now be described in detail with reference to the following Examples and Comparative Examples which do not limit the scope of the invention. In these Examples and Comparative Examples, the term parts means "parts by weight".

EXAMPLE 1

A reaction vessel was charged with 700 g of paraformaldehyde (85% in concentration), 1000 g of phenol and 5 g of zinc acetate, the mixture was heated at 100° to 125° C. and reaction was conducted for 3 hours. Water was removed for 1 hour under a reduced pressure of 700 mmHg to obtain a resin. Then, 900 g of methylethyl ketone and 300 g of xylene were added to the resin to obtain a resin solution A.

Separately, 750 g of crude diphenylmethane diisocyane was incorporated and dissolved in 250 g of xylene to form a resin solution B.

To 100 parts of molding sand (Sanei Sand No. 6; A.F.S. grain number=65) was added 0.4 part of kerosene as the organic solvent, and the mixture was kneaded at 140 rpm for 30 seconds by a Shinagawa type mixer to coat the surfaces of the sand grains with kerosene. Then, 1 part of the resin solution A and 1 part of the resin solution B were added to the kerosene-coated sand, and the mixture was kneaded for 30 seconds. The resulting resin-coated sand was blown into a mold for forming a transverse strength test piece and a test place having a size of 25 mm×25 mm ×120 mm was obtained by gas-passing curing while bubbling triethylamine in a tank with air. The transverse strength of the test pieces prepared by using the coated sand just after kneading, the coated sands after standing in a sealed vinyl plastic pouch for 2 and 4 hours after kneading were measured just after molding, 10 minutes after molding and 24 hours after molding.

COMPARATIVE EXAMPLE 1

In the same manner as described in Example 1, 1.0 part of the resin solution A and 1.0 part of the resin solution B were added to 100 parts of Sanei Sand No. 6 (A.F.S. grain fineness number=65), except that the molding sand was not coated with the organic solvent, and the mixture was kneaded and molded in transverse strength test pieces.

Results of the transverse strength test made on the test pieces obtained in Example 1 and Comparative Example 1 are shown in Table 1.

TABLE 1

| Example | Organic Solvent | Amount Added of Resin (per 100 parts of sand) | | Transverse Strength (Kg/cm²) Standing Time just after kneading | 2 hours after kneading | 4 hours after kneading |
|---|---|---|---|---|---|---|
| Comparative Example 1 | not added | 1 part of resin solution A and 1 part of resin solution B | just after molding | 14.0 | 12.0 | 10.0 |
| | | | 10 minutes after molding | 22.0 | 20.3 | 16.0 |
| | | | 24 hours after molding | 28.5 | 26.0 | 22.5 |
| Example 1 | 0.4 part of kerosene | 1 part of resin solution A and 1 part of resin solution B | just after molding | 17.0 | 17.5 | 15.0 |
| | | | 10 minutes after molding | 25.2 | 26.5 | 22.0 |
| | | | 24 hours after molding | 31.0 | 32.0 | 28.5 |

EXAMPLE 2

To 100 parts of bentonite-containing reclaimed sand of the green mold method, apparently inferior in the grade to standard sand, 1.0 part of kerosene was added, and the mixture was kneaded at 140 rpm for 30 seconds by a Shinagawa type mixer to coat the surfaces of sand grains with kerosene. Then, 1.5 parts of the resin solution A and 1.5 parts of the resin solution B were added to the coated sand, and the mixture was kneaded. In the same manner as described in Example 1, the resin-coated sand was blown into a tranverse strength test piece-forming mold having a size of 25 mm×25 mm×120 mm and test pieces were prepared by gas-passing curing while bubbling triethylamine in a tank by air. With respect to test pieces prepared by using the coated sand just after kneading, the coated sands after standing in a closed vinyl plastic pouch for 10 and 30 minutes after kneading, the transverse strengths thereof were measured just after molding, 10 minutes after molding and 24 hours after molding.

EXAMPLE 3

To 100 parts of the same reclaimed sand as used in Example 2 was added 1 part of ethyl cellosolve acetate and the mixture was kneaded by a mixer. Then, 1.5 parts of the resin solution A and 1.5 parts of the resin solution B were added to the coated sand, and the mixture was kneaded. In the same manner as described in Example 2, test pieces were molded and the transverse strengths thereof were measured.

EXAMPLE 4

To 100 parts of the same reclaimed sand as used in Example 2 as added 1.0 part of a mixture of ethyl cellosolve acetate and kerosene, the ratio of ethyl cellosolve acetate/kerosene being 1/4, and the mixture was kneaded by a mixer. Then, 1.5 parts of the resin solution A and 1.5 parts of the resin solution B were added to the coated sand and the mixture was kneaded. In the same manner as described in Example 2, test pieces were prepared and the transverse strenghts thereof were measured.

COMPARATIVE EXAMPLE 2

To 100 parts of the same reclaimed sand as used in Example 2 were added 2.0 parts of the resin solution A and 2.0 parts of the resin solution B without the addition of the organic solvent, and the mixture was kneaded. In the same manner as described in Example 2, test pieces were molded and the transverse strengths thereof were measured.

COMPARATIVE EXAMPLE 3

To 100 parts of the same reclaimed sand as used in Example 2 were simultaneously added 1 part of kerosene, 1.5 parts of the resin solution A and 1.5 parts of the resin solution B, and the mixture was kneaded. In the same manner as described in Example 2, test pieces were molded and the transverse strengths thereof were measured.

Results of the transverse strenght test made on the test pieces prepared in the foregoing Examples 2, 3, 4 and Comparative Examples 2, 3 are shown in Table 2.

TABLE 2

| Example | Organic Solvent (per 100 parts of sand) | Amount Added of Resin (per 100 parts of sand) | | Transverse Strength (Kg/cm²) Standing Time just after kneading | 10 minutes after kneading | 30 minutes after kneading |
|---|---|---|---|---|---|---|
| Example 2 | 1.0 part of kerosene | 1.5 parts of resin solution A and 1.5 parts of resin solution B | just after molding | 13.5 | 12.3 | 8.0 |
| | | | 10 minutes after molding | 20.3 | 18.2 | 12.8 |
| | | | 24 hours after molding | 25.2 | 23.0 | 17.6 |
| Example 3 | 1.0 part of ethyl cellosolve acetate | 1.5 parts of resin solution A and 1.5 parts of resin solution B | just after molding | 11.8 | 11.0 | 11.3 |
| | | | 10 minutes after molding | 17.5 | 17.9 | 16.8 |
| | | | 24 hours after molding | 21.3 | 20.6 | 20.5 |
| Example 4 | 1.0 part of ¼ mixture of ethyl cellosolve acetate/kerosene | 1.5 parts of resin solution A and 1.5 parts of resin solution B | just after molding | 14.0 | 13.2 | 11.2 |
| | | | 10 minutes after molding | 21.0 | 20.5 | 17.9 |
| | | | 24 hours after molding | 26.0 | 25.2 | 23.2 |
| Comparative | not added | 2.0 parts of resin | just after molding | 11.0 | 8.2 | 5.1 |

TABLE 2-continued

| Example | Organic Solvent (per 100 parts of sand) | Amount Added of Resin (per 100 parts of sand) | | Transverse Strength (Kg/cm²) Standing Time just after kneading | 10 minutes after kneading | 30 minutes after kneading |
|---|---|---|---|---|---|---|
| Example 2 | | solution A and 2.0 parts of resin solution B | 10 minutes after molding | 15.0 | 11.0 | 7.3 |
| | | | 24 hours after molding | 19.2 | 23.2 | 8.5 |
| Comparative Example 3 | simultaneous addition of 1.0 part of kerosene, 1.5 parts of resin solution A and 1.5 parts of resin solution B, followed by kneading | | just after molding | 8.5 | 6.5 | molding |
| | | | 10 minutes after molding | 11.7 | 8.2 | was |
| | | | 24 hours after molding | 13.4 | 10.2 | impossible |

EXAMPLE 5

A reaction vessel was charged with 550 g of paraformaldehyde (85% in concentration), 1000 g of phenol and 10 g of zinc naphthenate, the mixture was heated at 100° to 125° C. and reaction was conducted for 4 hours while distilling water. Then, water was removed for 1 hour under a reduced pressure of 700 mmHg to obtain a resin. Then, the thus formed resin was incorporated and dissolved in 800 g of butyl cellosolve acetate and 200 g of xylene to form a resin solution C. Separately, 800 g of crude diphenylmethane diisocyanate was incorporated and dissolved in 200 g of xylene to form a resin solution D.

To 100 parts of Hamaoka sand (A.F.S. grain fineness number=52) was added 0.4 parts of a 1/4 mixed solvent of ethyl cellosolve acetate/kerosene "a 1/4 mixed solvent of ethylcellosolve acetate/kerosene" means the mixture in which the ratio of ethylcellosolve acetate to kerosene is 1:4 as an organic solvent, and the mixture was kneaded at 140 rpm for 30 seconds by a Shinagawa type mixer to coat the surfaces of the sand grains with the organic solvent.

Next, 2.0 parts of N-ethylmorpholine as a curing agent and 1.0 part of the resin solution C were added to the resulting precoated sand and then kneaded at 140 rpm for 30 seconds by a Shinagawa type mixer. Then, 1.0 part of the resin solution D was added to the kneaded mixture and the resulting mixture was further kneaded for 30 seconds. The resulting resin-coated sand grains were packed and molded in a transverse stength test piecemolding mold having a diameter of 50 mm and a height of 50 mm, and allowed to stand at normal temperatures for 1 hours, 2 hours, 4 hours and 24 hours. Then, the transverse strength of each test piece was measured.

COMPARATIVE EXAMPLE 4

To 100 parts of the same Hamaoka sand as used in Example 5, 1.0 part of the resin solution C containing 2.0 parts of N-ethylmorpholine as a curing agent per 100 parts of the resin solution C (2.0/100 parts) was added without addition of the organic solvent, and the resulting mixture was kneaded. Then, 1.0 part per 100 parts of the sand of the resin solution D was added to the kneaded mixture, and the resulting mixture was kneaded and molded. Each test piece was allowed to stand for a predetermined time and the transverse strength thereof was measured.

Results of the transverse strength test made on the test pieces obtained in Example 5 and Comparative Example 4 are shown in Table 3.

TABLE 3

| | Comparative Example 4 | Example 5 |
|---|---|---|
| Organic Solvent | not pre-coated | 0.4 part of ¼ mixed solvent of ethyl cellosolve acetate/kerosene |
| Added Amount of Resin (per 100 parts of sand) | 1.0 part of resin solution C and 1.0 part of resin solution D | 1.0 part of resin solution C and 1.0 part of resin solution D |
| Curing Agent (per 100 parts of resin solution C) | 2 parts of N—ethylmorpholine | 2 parts of N—ethylmorpholine |
| Transverse Strength (Kg/cm²) | | |
| after 1 hour's standing | 12 | 20 |
| after 2 hours' standing | 26 | 36 |
| after 4 hours' standing | 40 | 53 |
| after 24 hours' standing | 58 | 72 |
| Bench Life (minutes) | 6 | 13 |

As will be apparent from the foregoing description, in the present invention, since sand grains are coated with an organic solvent in advance and this organic solvent acts as a good solvent to a resin binder to be applied afterwards, the adhesion of the binder to the surfaces of sand grains is enhanced and hence, the amount of the binder to be added to sand grains can be reduced. Furthermore, even if the added amount of the binder is thus reduced, a casting mold having a high strength can be prepared from the resin-coated molding sand of the present invention.

Furthermore, even if reclaimed sand having a high alkaline component content is used in the process of the present invention, since sand grains are coated with an organic solvent in advance, reaction of the alkaline component with the binder is inhibited and the bench life is prolonged.

According to the process of the present invention, irrespective of the ordinary molding sand customarily being used or molding sand of a low grade being used, there can be obtained a casting mold having a high strength. Furthermore, the added amount of the binder can be reduced remarkably as compared with the amount of the binder used in the conventional process. Therefore, the present invention is very advantageous in various points.

What is claimed is:

1. A process for the preparation of a resin-coated molding sand, which comprises coating sand grains with a liquid binder comprising a phenolic resin component and a polyisocyanate component, wherein the sand grains are coated with an organic solvent prior to the coating of the sand grains with the liquid binder.

2. A process for the preparation of a resin-coated molding sand according to claim 1, wherein the organic solvent is at least one member selected from the group consisting of aliphatic hydrocarbons, aromatic hydrocarbons, halogenated hydrocarbons, ketones, esters, ethers, alcohols, fatty acids, kerosene, light oil, fuel oil and naphtha fractions.

3. A process for the preparation of a resin-coated molding sand according to claim 2, wherein the organic solvent is at least one member selected from the group consisting of aliphatic hydrocarbons, aromatic hydrocarbons, halogenated hydrocarbons, ketones, esters, kerosene, light oil, fuel oil and naphtha fractions.

4. A process for the preparation of a resin-coated molding sand according to claim 2 or 3, wherein the aliphatic hydrocarbon is at least one member selected from the group consisting of n-hexane, n-heptane and iso-octane.

5. A process for the preparation of a resin-coated molding sand according to claim 2 or 3, wherein the aromatic hydrocarbon is at least one member selected from the group consisting of benzene, toluene, xylene and ethylbenzene.

6. A process for the preparation of a resin-coated molding sand according to claim 2 or 3, wherein the halogenated hydrocarbon is at least one member selected from the group consisting of carbon tetrachloride and chlorobenzene.

7. A process for the preparation of a resin-coated molding sand according to claim 2 or 3, wherein the ketone is at least one member selected from the group consisting of acetone, methylisobutyl ketone, isophorone and cyclohexanone.

8. A process for the preparation of a resin-coated molding sand according to claim 2 or 3, wherein the ester is at least one member selected from the group consisting of ethyl acetate, diethyl oxalate and diethyl phthalate.

* * * * *